United States Patent [19]

Hosaka et al.

[11] Patent Number: 4,483,300

[45] Date of Patent: Nov. 20, 1984

[54] FEEDBACK AIR FUEL RATIO CONTROL SYSTEM AND METHOD

[75] Inventors: Akio Hosaka, Yokohama; Hiroshi Yamaguchi, Yokosuka, both of Japan

[73] Assignee: Nissan Motor Company, Limited, Yokohama, Japan

[21] Appl. No.: 340,278

[22] Filed: Jan. 18, 1982

[30] Foreign Application Priority Data

Jan. 20, 1981 [JP] Japan ..... 56-005937

[51] Int. Cl.[3] ..... F02M 51/00

[52] U.S. Cl. ..... 123/489; 123/440

[58] Field of Search ..... 123/440, 478, 480, 486, 123/487, 489; 73/23

[56] References Cited

U.S. PATENT DOCUMENTS

| | | | |
|---|---|---|---|
| 4,111,171 | 9/1978 | Aono et al. | 123/440 |
| 4,116,169 | 9/1978 | Krupp et al. | 123/489 X |
| 4,301,780 | 11/1981 | Hoshi | 123/483 X |
| 4,337,745 | 7/1982 | Pomerantz | 123/440 |

FOREIGN PATENT DOCUMENTS

| | | |
|---|---|---|
| 2713988 | 10/1978 | Fed. Rep. of Germany . |
| 2832187 | 2/1979 | Fed. Rep. of Germany . |

*Primary Examiner*—Parshotam S. Lall
*Assistant Examiner*—W. R. Wolfe
*Attorney, Agent, or Firm*—Schwartz, Jeffery, Schwaab, Mack, Blumenthal & Koch

[57] ABSTRACT

A feedback air fuel ratio control system or method for a multi-cylinder engine is arranged not only to control the average value of the air fuel ratios among the cylinders but also to control the individual air fuel ratio of the individual cylinders so as to level the cylinder to cylinder air fuel distribution. This is done, for example, by directly detecting which cylinder is a source of the air fuel deviation by examining the oxygen sensor signal fluctuation in relation of time and individually regulating a fuel injector for that cylinder. In the case of an engine with a carburetor, the carburetor is controlled in relation with time in accordance with the sequence of the intake periods of the individual cylinders to control the individual air fuel ratio.

15 Claims, 13 Drawing Figures

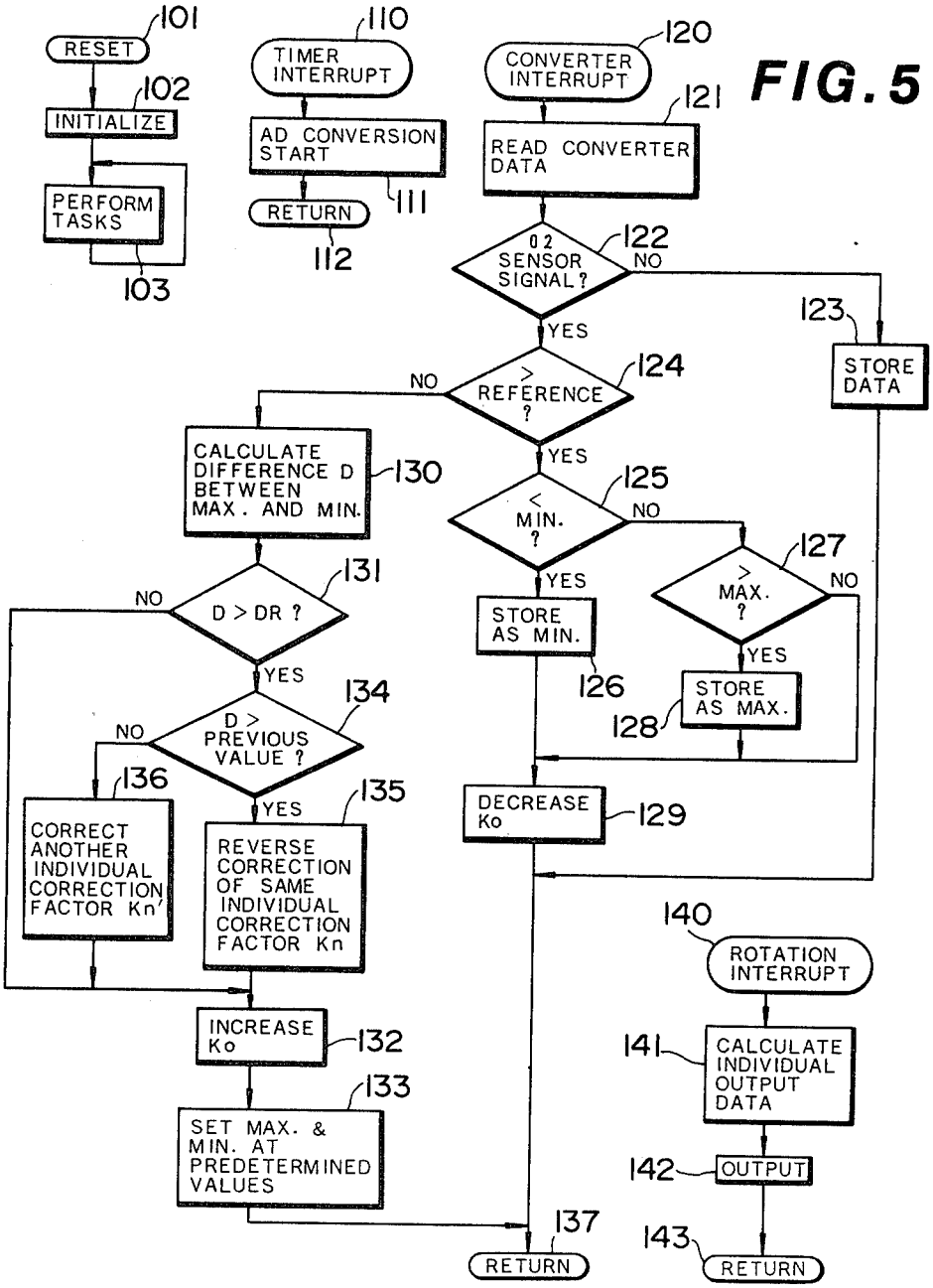
FIG. 5
RESET
101
INITIALIZE
102
PERFORM TASKS
103
TIMER INTERRUPT
110
AD CONVERSION START
111
RETURN
112
CONVERTER INTERRUPT
120
READ CONVERTER DATA
121
O2 SENSOR SIGNAL ?
122
NO
YES
STORE DATA
123
> REFERENCE ?
124
NO
YES
CALCULATE DIFFERENCE D BETWEEN MAX. AND MIN.
130
< MIN. ?
125
NO
YES
STORE AS MIN.
126
> MAX. ?
127
NO
YES
STORE AS MAX.
128
D > DR ?
131
NO
YES
D > PREVIOUS VALUE ?
134
NO
YES
CORRECT ANOTHER INDIVIDUAL CORRECTION FACTOR Kn'
136
REVERSE CORRECTION OF SAME INDIVIDUAL CORRECTION FACTOR Kn
135
DECREASE Ko
129
INCREASE Ko
132
SET MAX. & MIN. AT PREDETERMINED VALUES
133
RETURN
137
ROTATION INTERRUPT
140
CALCULATE INDIVIDUAL OUTPUT DATA
141
OUTPUT
142
RETURN
143

FEEDBACK AIR FUEL RATIO CONTROL SYSTEM AND METHOD

BACKGROUND OF THE INVENTION

The present invention relates to a closed-loop air fuel ratio control system and method for supplying an optimum air fuel mixture to an internal combustion engine.

Such a control system or method makes use of an exhaust gas sensor or oxygen sensor for sensing the concentration of the oxygen in the exhaust gas from the engine, and controls the air fuel ratio depending upon the result of the comparison between the output signal of the exhaust gas sensor and a predetermined reference value.

However, such a control system or method is arranged to only decide whether or not the sensor output signal is greater than the reference value, that is, whether or not the detected air fuel ratio is smaller than the stoichiometric value, and thus to control the air fuel ratio, without cylinder to cylinder variation, if it is applied to a multi-cylinder engine, to maintain the mean value among the cylinders constant. Accordingly, such control system and method are helpless against bad influences of a cylinder to cylinder air fuel ratio distribution on emission control and fuel economy.

SUMMARY OF THE INVENTION

It is therefore an object of the present invention to provide feedback air fuel ratio control system and method which are arranged not only to control the average value of the air fuel ratios among the cylinders but also control the individual air fuel ratios of the individual cylinders so as to level the cylinder to cylinder air fuel distribution.

The feedback air fuel ratio control system for a multi-cylinder engine according to the present invention comprises an air fuel ratio sensor for sensing an exhaust gas composition at a confluence of exhaust streams from individual cylinders and producing a sensor signal indicative of air fuel ratio, a control unit for producing a control signal in accordance with the sensor signal, and fuel supplying means for supplying, to the individual cylinders, an air fuel mixture of a controlled air fuel ratio under the command of the control signal. The control unit of this system comprises means for examining the fluctuation of the sensor signal to detect the cylinder to cylinder air fuel ratio distribution, and means for modifying the control signal so as to make the detected cylinder to cylinder air fuel ratio distribution uniform. Besides, the fuel supplying means is capable of providing each cylinder with a mixture of an air fuel ratio controlled differently from others under the command of the modified control signal.

The feedback air fuel ratio control method for a multi-cylinder engine comprises the steps of sensing an exhaust gas composition at a confluence of exhaust streams from the individual cylinders and producing a sensor signal indicative of the air fuel ratio; producing a control signal in accordance with the sensor signal: examining the fluctuation of the sensor signal to detect the cylinder to cylinder distribution of the air fuel ratio; modifying the control signal so as to make the detected cylinder to cylinder air fuel ratio distribution uniform; and supplying to each individual cylinder an air fuel mixture of an air fuel ratio controlled differently from others under the command of the modified control signal.

BRIEF DESCRIPTION OF THE DRAWINGS

FIG. 5 is a flowchart used in the first embodiment;

FIGS. *9a–9d* shows various waveforms which appear in various stages of the control system of the third embodiment.

DETAILED DESCRIPTION OF THE INVENTION

Figure 1:
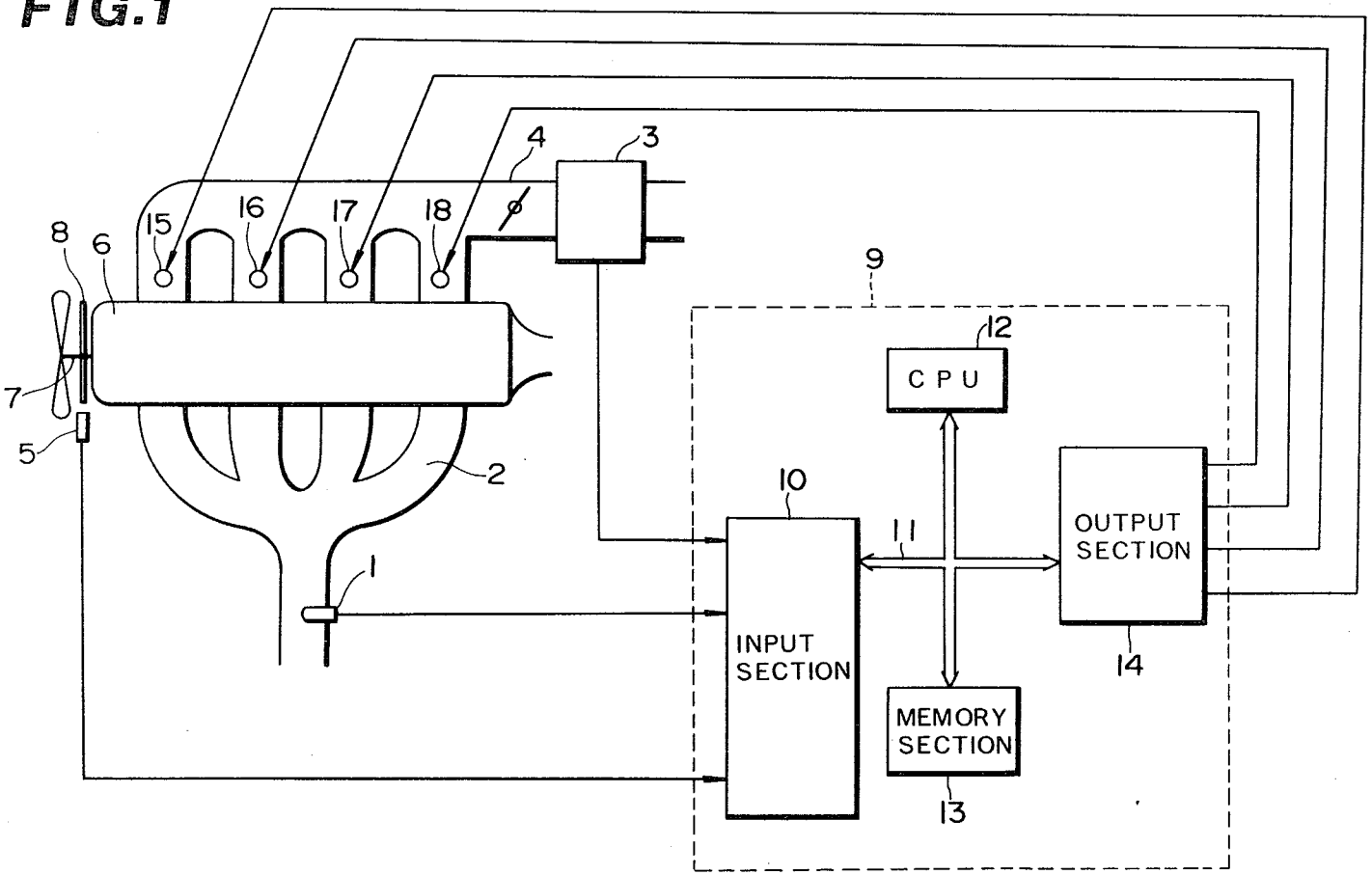
FIG. 1 is a schematic illustration of a feedback air fuel ratio control system showing a first embodiment of the present invention.

A first embodiment of the present invention is shown in FIG. 1. An oxygen sensor 1 is placed at a meeting portion of an exhaust manifold 2 of a multicylinder engine 6. There are further provided an intake air quantity sensor 3 placed in an intake pipe 4 and a rotation pickup 5 for sensing rotation of a disc 8 attached to a crankshaft 7.

Output signals of the oxygen sensor 1, the air quantity sensor 3 and the rotation pickup 5 are supplied to a control unit 9 comprising a microcomputer. In an input section 10 of the control unit 9, some of input signals are converted to digital form by an analog-to-digital converter, and the output signal of the rotation pickup 5, for example, is converted by a pulse counting circuit, into a digital signal indicative of engine speed. After that, all these signals are transferred to a control section or central processing unit (CPU) 12 through a bus 11.

The CPU transfers data to and from a memory section 13, processes the input data and sends output data to an output section 14. In response to the output data of the CPU 12, the output section 14 delivers control signals to injectors 15 to 18 of individual cylinders to control fuel supplies to individual cylinders.

In the input section 10, there is provided a circuit for generating interrupt request signals at the times when the rotation pickup signal is input and when the AD converter completes a conversion, and every predetermined cycle.

Figure 2:
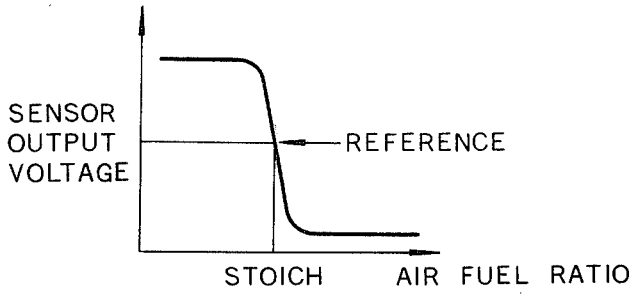
FIG. 2 is a diagram showing a characteristic curve of an oxygen sensor.

The thus arranged control system operates as follows: An output characteristic of the oxygen sensor 1 is shown in FIG. 2, in which there is a steep transition near the stoichiometric point. Around the stoichiometric point, the sensor output voltage varies almost linearly with respect to the air fuel ratio. A feedback control is performed on the basis of the air fuel ratio which is known from the comparison between the oxygen sensor output voltage and a predetermined reference value. Thus, the air fuel ratio is maintained near the stoichiometric air fuel ratio while it swings on both sides of the reference value owing to a controlled oscillation caused mainly by a transport delay time for the air fuel mixture to travel to the oxygen sensor.

Figure 3:
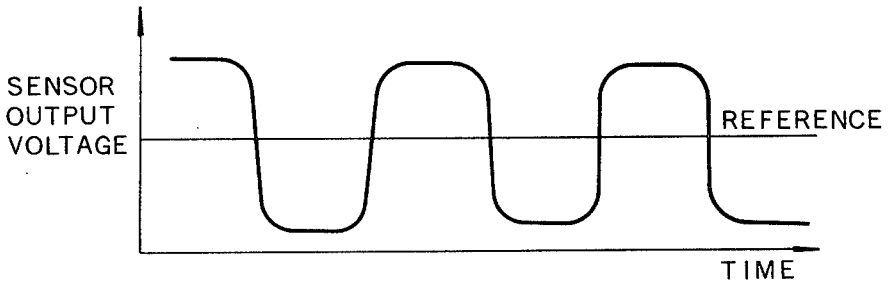
FIG. 3 is a diagram showing a waveform of the oxygen sensor output signal in a state where there is no uneven cylinder to cylinder air fuel ratio distribution.
Figure 4:
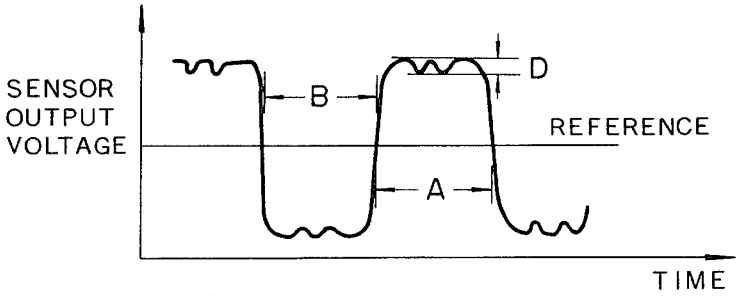
FIG. 4 is a diagram showing a waveform of the oxygen sensor output signal with small scale fluctuations due to uneven cylinder to cylinder air fuel ratio distribution.

If there is no unevenness of the air fuel ratio from cylinder to cylinder, the oxygen sensor 1 exhibits an output voltage curve shown in FIG. 3. However, the air fuel ratios are different from cylinder to cylinder in an actual engine, and the exhaust gas from each cylinder reaches the oxygen sensor 1 at different times. Therefore, the oxygen sensor output voltage fluctuates on a small scale each time the exhaust gas from each cylinder reaches the oxygen sensor 1. Thus, there are small scale fluctuations both in rich periods A and lean periods B, as shown in FIG. 4. A capital letter D in FIG. 4 stands for the difference between the maximum value and the minimum value in such a sensor signal fluctuation.

The control system of FIG. 1 is arranged to detect and reduce the small scale fluctuations of the oxygen sensor signal, thereby to level the cylinder to cylinder air fuel ratio distribution caused by cylinder to cylinder variations in fuel injection quantity and irregular distribution of intake air. This is done by following a flowchart shown in FIG. 5, for example.

First, a reset circuit (not shown) resets various portions of the control unit 9 when a power supply is connected to the control unit. In response to a reset signal, the CPU 12 begins executing the program from a step 101. At a step 102, the CPU initializes various parts in a microcomputer, and then repeats normal data processing procedure at a step 103.

In this procedure, the CPU calculates a basic impulse time Tp for the fuel injectors depending upon engine speed and intake air quantity, and a correction factor Kw for increasing the impulse time Tp in accordance with various input data (not shown), such as coolant temperature, throttle position and start position of an ignition switch.

Upon reception of each timer interrupt signal periodically produced by a timer of the input section 10, the CPU halts its normal operations of the step 103 and begins to execute a special routine beginning from a step 110. At a step 111, the CPU commands the analog-to-digital converter to start its operation. A signal to be converted is selected among various kinds of input signals by designating a channel of a multiplexer. After completing the interrupt routine, the CPU returns to the suspended routine at a step 112 and continues it.

Upon completion of its conversion, the analog-to-digital converter generates a converter interrupt signal. In response to the converter interrupt signal, the CPU begins executing an interrupt routine beginning from a step 120. In this routine, the CPU first reads the output data of the analog-to-digital converter at a step 121, and then determines whether it is the oxygen sensor signal or not, at a step 122. If it is not, it is stored, at a step 123, in a given location of a read/write RAM depending upon data sources. The data thus stored in the memory section is used in the operations of step 103. If the input data is the oxygen sensor signal, it is further determined at a step 124, whether it is greater than a predetermined reference value. If it is, that is, the oxygen sensor signal is in the period A of FIG. 4, then it is compared with a preset minimum value at a step 125. If the input data is smaller than the preset minimum value, it is stored as a new minimum value, at a step 126. If the input data is greater than the preset minimum value, it is compared with a preset maximum value at a step 127, and a stored as a new maximum value at a step 128 if it is greater than the preset maximum value.

Finding of the minimum value is somewhat difficult in this case because the oxygen sensor output voltage during the transition period near the reference value is liable to be regarded as the minimum value. In order to avoid such a confusion, it is necessary to make a check after some time delay or to place a lower limit upon the oxygen sensor signal to be checked.

Thus, the CPU finds and stores the maximum value and the minimum value in the oxygen sensor signal fluctuations shown in FIG. 4. At a step 129, the CPU decreases a total correction factor KO common to all the cylinders in order to increase the air fuel ratio because, in this branch of the flowchart, the oxygen sensor indicates that the air fuel ratio is too low. The total correction factor is determined in accordance with a proportional plus integral control mode, for example.

If, on the other hand, it is decided, at the step 124, that the oxygen sensor signal is smaller than the reference value, that is, the oxygen sensor signal is in the period B of FIG. 4, then the CPU, at a step 130, calculates the difference D between the maximum value and the minimum value which are stored in the steps 126 and 128. At a next step 131, the CPU compares the difference D with a predetermined value DR which may be a constant or a function of engine speed, air flow rate, etc. If D is smaller than DR, the CPU judges the difference is within a permissible range, and goes directly to a step 132, where it increases the total correction factor K0 to lower the air fuel ratio. At a next step 133, the CPU sets the maximum value and the minimum value at the predetermined values, respectively, for use in the next check in the period A. If D is greater than DR, the CPU regards the cylinder to cylinder air fuel ratio distribution as too great and tries to correct a fuel injection quantity for each cylinder.

For doing this, it is possible to employ, for example, a learning system, as follows: The CPU compares, at a step 134, the value of D currently being examined with a previous value of D which is a result of the previous period A. If D is greater than the previous value, this leads to a judgement that the correction of the individual fuel injection quantity is not properly arranged, so that the CPU reverses the direction of the correction at a step 135.

For example, if an increase of the individual correction factor K1 for the number one cylinder in the previous time results in an increase of the difference D, the CPU decreases K1 this time. If, on the contrary, D is decreased by the correction of K1 in the previous time, then the CPU judges the correction of the number one cylinder is satisfactory, and goes to a step 136, where the correction is made for the individual correction factor of another cylinder, for example, K2 of the number two cylinder.

However, it is optional to continue the correction of K1 until D can not be decreased any longer, and after that, turn to the correction of K2.

Thus, the CPU corrects, in turn, the individual correction factors K1 to K4 for the number one to four cylinders, and finds the optimum values for the individual correction factors Kn, respectively.

In order to more exactly detect the increasing or decreasing trend of the difference D, it is sometimes advisable to use the average value of D of several checks, or to interpose somewhat long time interval between each check.

In response to an output signal of the rotation pickup 5, the CPU starts executing a rotation interrupt routine beginning at a step 140. At a step 141, the CPU calculates an individual effective impulse time Te for each cylinder from the correction factors calculated in the above mentioned procedure. The individual effective impulse time Te for each cylinder is given by $$Te = Tp \times Kw \times KO \times Kn,$$

where $Tp \times Kw \times KO$ is common to all the cylinders and Kn is peculiar to each cylinder. At a step 142, the CPU transfers the thus obtained data to the output section 14, which in turn, delivers control signals to the injectors 15 to 18, respectively, to command them to supply controlled amount of fuel to each cylinder.

It is also possible to control the air fuel ratio by controlling the intake air quantity. This is done by regulating the opening degree of valves each of which is placed in the intake port of each cylinder and provided with a servo mechanism, or by regulating the opening time of the intake valve of each cylinder.

Figure 6A:
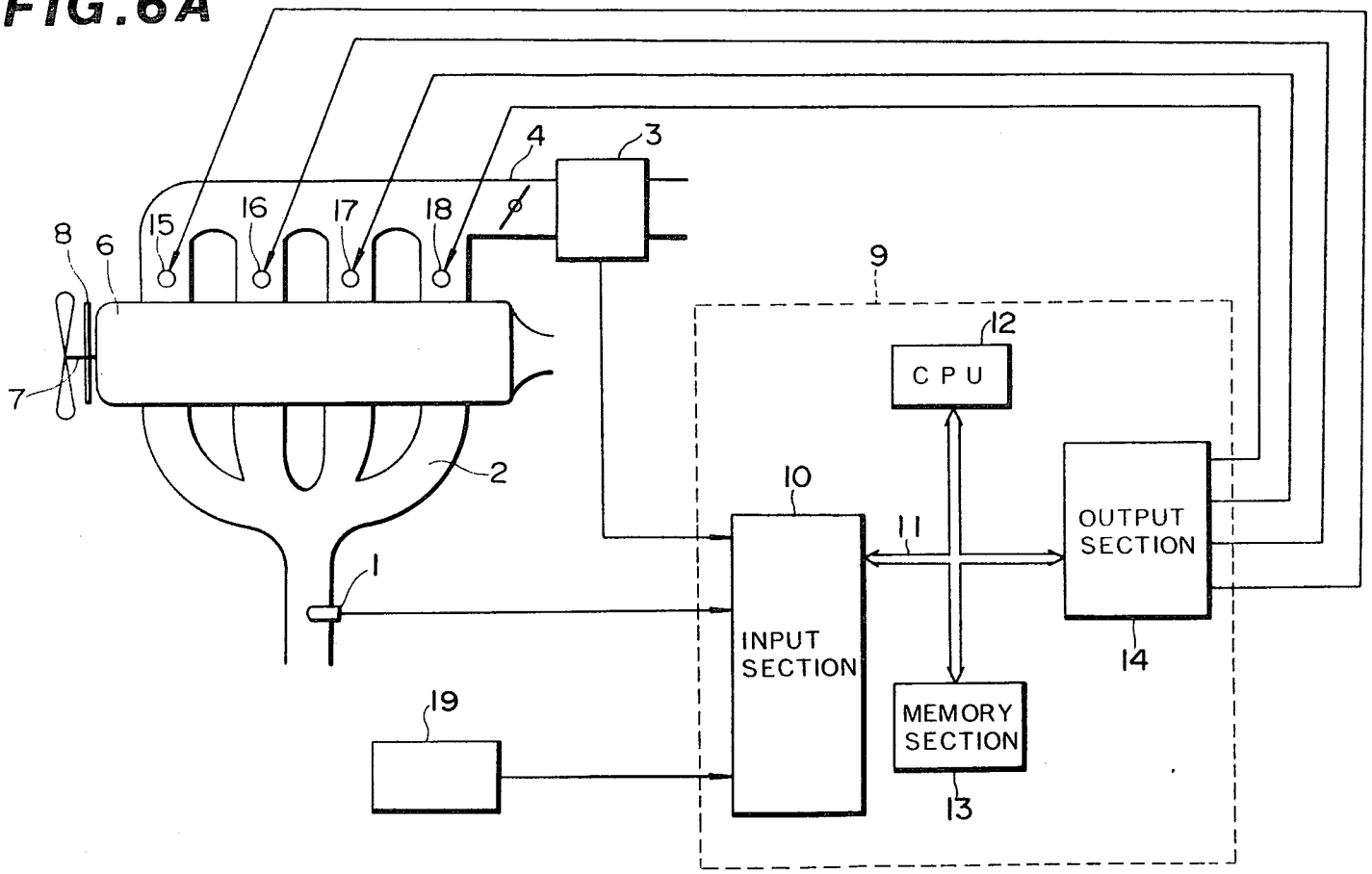
FIG. 6A is a schematic illustration of a second embodiment of the present invention.
Figure 6B:
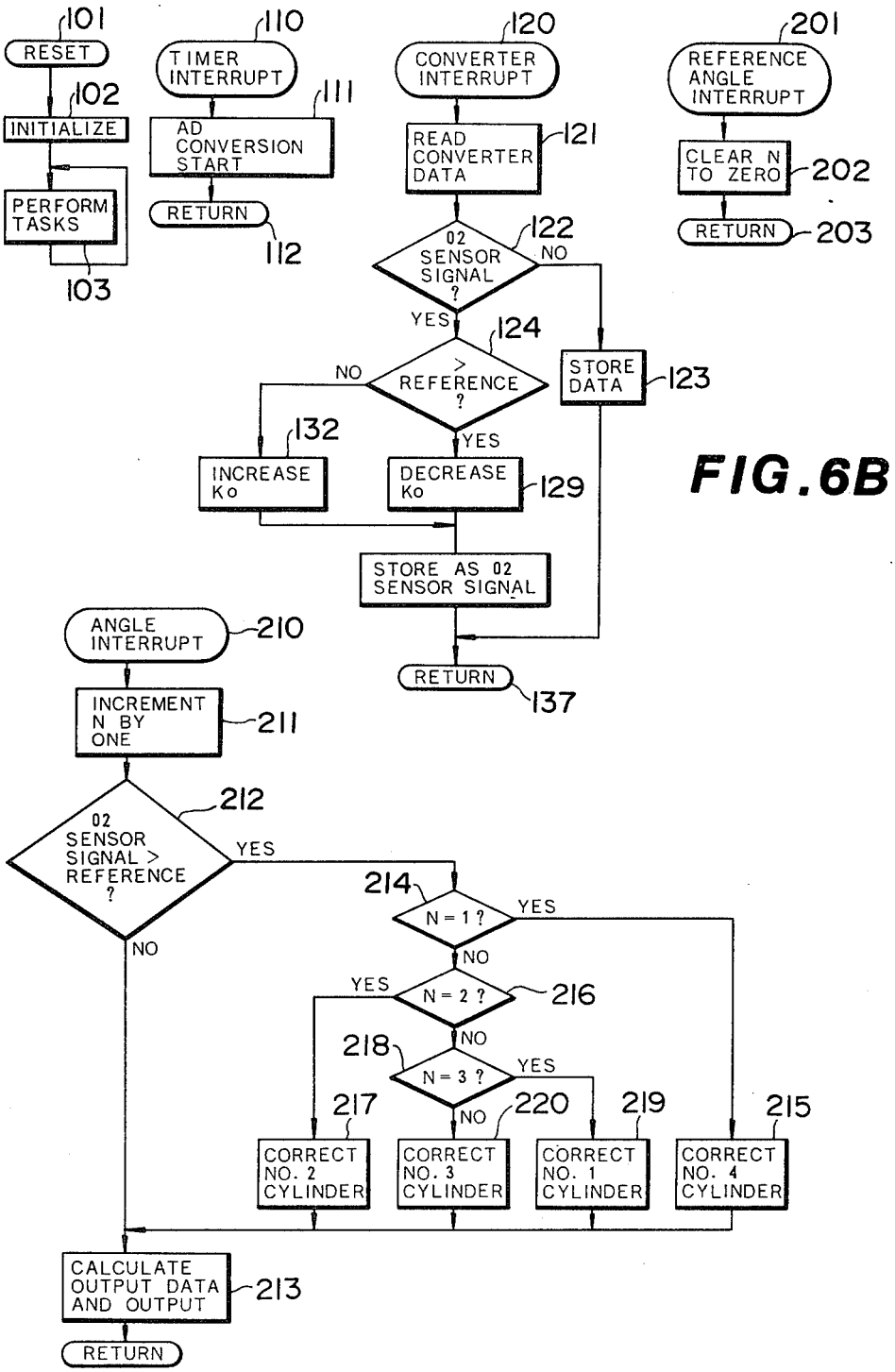
FIG. 6B is a flowchart used in a second embodiment of the present invention.

A second embodiment of the present invention is shown in FIGS. 6A and 6B, in which the CPU is arranged to detect the air fuel ratio deviation of each cylinder.

In this embodiment, there is provided timing detecting the means 19 for detecting engine operation cycle, whose output signal is sent to the control unit 9.

Examples of the timing detecting means are a pickup for detecting the angular position of the distributor rotation axis, and a current detector for detecting secondary current of the ignition system.

On the basis of the output signal of the timing detecting means, the CPU decides which cylinder is a source of the unevenness of the air fuel ratio.

A program example for this embodiment for a four cylinder four cycle engine is shown in FIG. 6B, which makes use of reference signals generated every distributor revolution at an instant when the piston of the number one cylinder reaches a position just before the top dead center on the compression stroke, and angle signals generated every time the piston of any one cylinder reaches the top dead center on the exhaust stroke (that is, every 90° of the distributor rotation). Both of the reference signals and the angle signals are arranged to request the CPU to interrupt. In this case, there is no need for the rotation pickup 5 of FIG. 1, because the reference signals and the angle signals can perform the same functions.

In the program of FIG. 6B, a reset routine 101 to 103 and a timer interrupt routine 110 to 112 are the same as those of FIG. 5. A converter interrupt routine 120 to 137 is almost the same as that of FIG. 5, except that the CPU does not calculate the maximum value and the minimum value, but only stores the oxygen sensor signal after increasing the total correction factor KO if the sensor signal is greater than the reference value and decreasing KO if it is smaller than the reference value.

When an interrupt is requested by the reference signal, the CPU enters a reference interrupt routine 201 to 203, in which the CPU, at a step 202, clears to zero a count N which is used in an angle interrupt routine, and then returns to the suspended operation at a step 203.

When an interrupt is requested by the angle signal, the CPU enters the angle interrupt routine beginning from a step 210. At a step 211, the CPU increases the count N by one. Thus, N is cleared to zero every entry to the reference interrupt routine and increased by one every entry to the angle interrupt routine, thus providing data to decide which cylinder is in the state where its piston reaches the top dead center on the exhaust stroke. Assuming that the engine has four cylinders with the firing order of 1,3,4,2, by way of example, the reference signal is produced and N is cleared to zero just before the top dead center on the intake stroke of the number one cylinder, and the next angle signal is produced and N is set to one at the top dead center on the exhaust stroke of the number four cylinder.

Accordingly, if it is confirmed that N is 1 at a step 214, then one can judge that the piston of the number four cylinder is at the top dead center on the exhaust stroke, slightly before the completion of the exhaust period. Thus, the program goes to a step 215, where the CPU corrects the individual correction factor K4 for the number four cylinder in response to a current entry value of the oxygen sensor signal on the basis of the judgement that the number four cylinder predominantly influences the oxygen sensor signal at this given time. Similarly, the CPU checks N at steps 216 and 218, to decide which cylinder to correct, and goes to steps 217, 219 or 220 depending upon N.

At the correction step 215, for example, the CPU compares the current entry value of the oxygen sensor signal with the average of the oxygen sensor signal values each of which is regarded as attributable to each one of the cylinders and stored at each of the steps 215, 217, 219 and 220. In accordance with the result of the comparison, the CPU detects the air fuel ratio deviation of the number four cylinder from the average, and corrects the individual correction factor K4 so as to bring it closer to the average. At the correction steps 217, 219 and 220, the CPU corrects K2, K1 and K3, respectively, in a similar manner.

In order that a test for detecting the unevenness of the air fuel ratio is made during the period A of FIG. 4, there is provided a step 212 where the oxygen sensor signal is compared with the reference value. At a step 213, the CPU calculates output data for each of the cylinders and sends them to the output section 14.

In order to detect more exactly the influence of each cylinder on the air fuel ratio, it is preferable to take into consideration a transport delay time for an exhaust gas to reach the sensor and accordingly to read the oxygen sensor signal after the lapse of a time interval corresponding to the delay.

Usually, power to the control unit is removed when the engine is stopped, so that the contents of volatile memories in the control unit is lost. Accordingly, in the first and the second embodiments, a provision of necessary protection of the stored information on the calculated individual correction factors against volatility saves much time to recover the optimum values of the individual correction factors by retracing the previous steps. Such protection against volatility could take the form of using nonvolatile storage or providing a nonvolatile back-up power supply.

Figure 7:
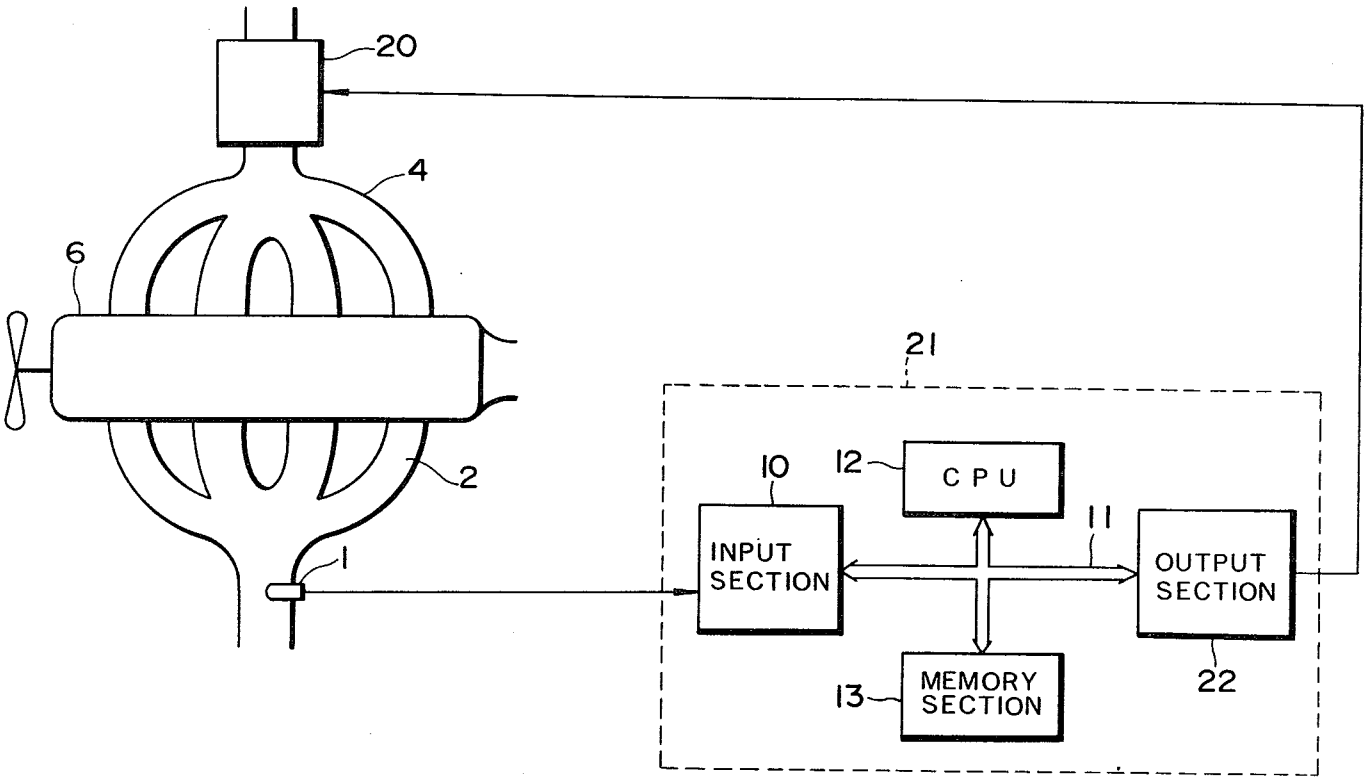
FIG. 7 is a schematic illustration of the feedback air fuel ratio control system showing a third embodiment of the present invention.
Figure 8:
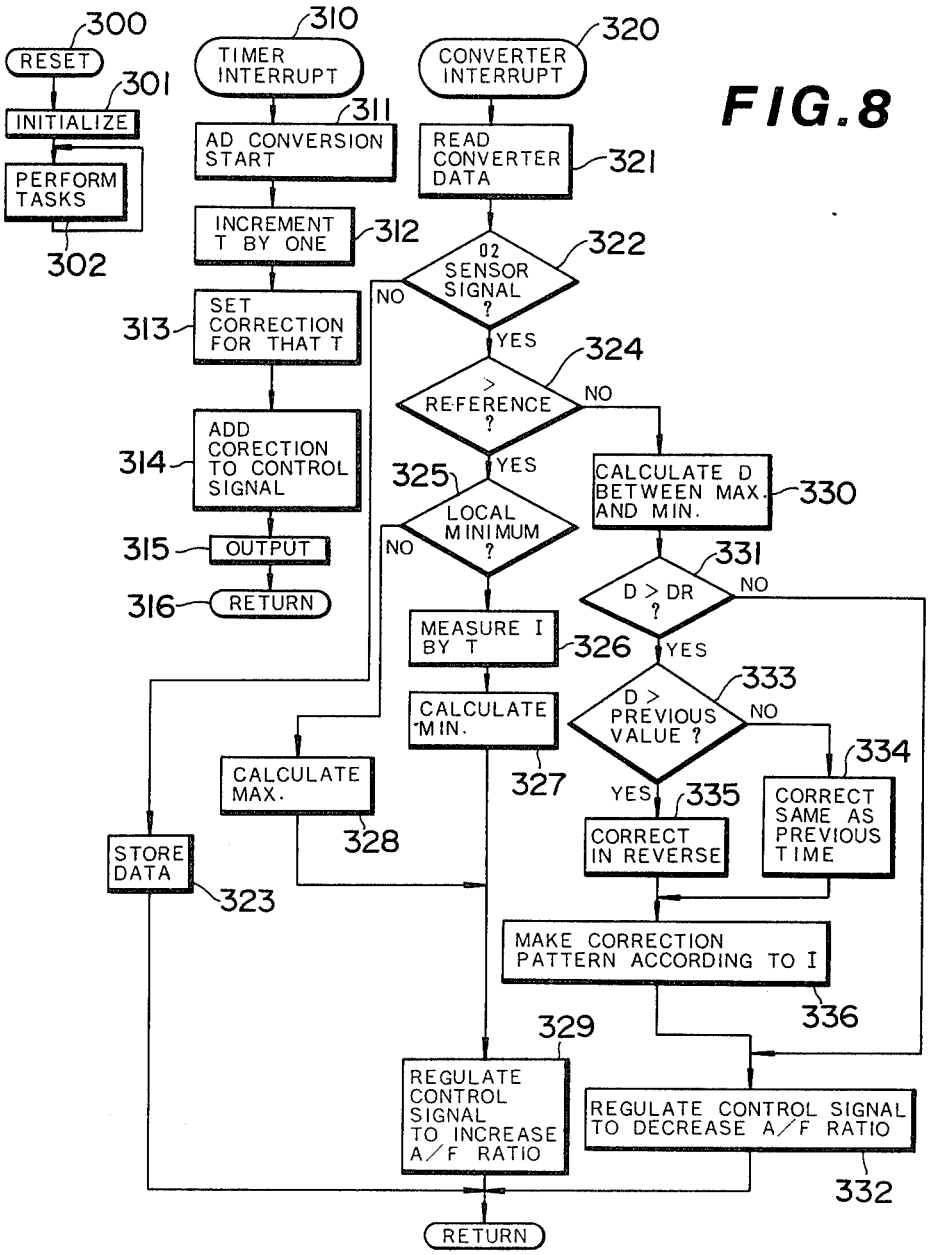
FIG. 8 is a flowchart used in the third embodiment.
Figure 9:
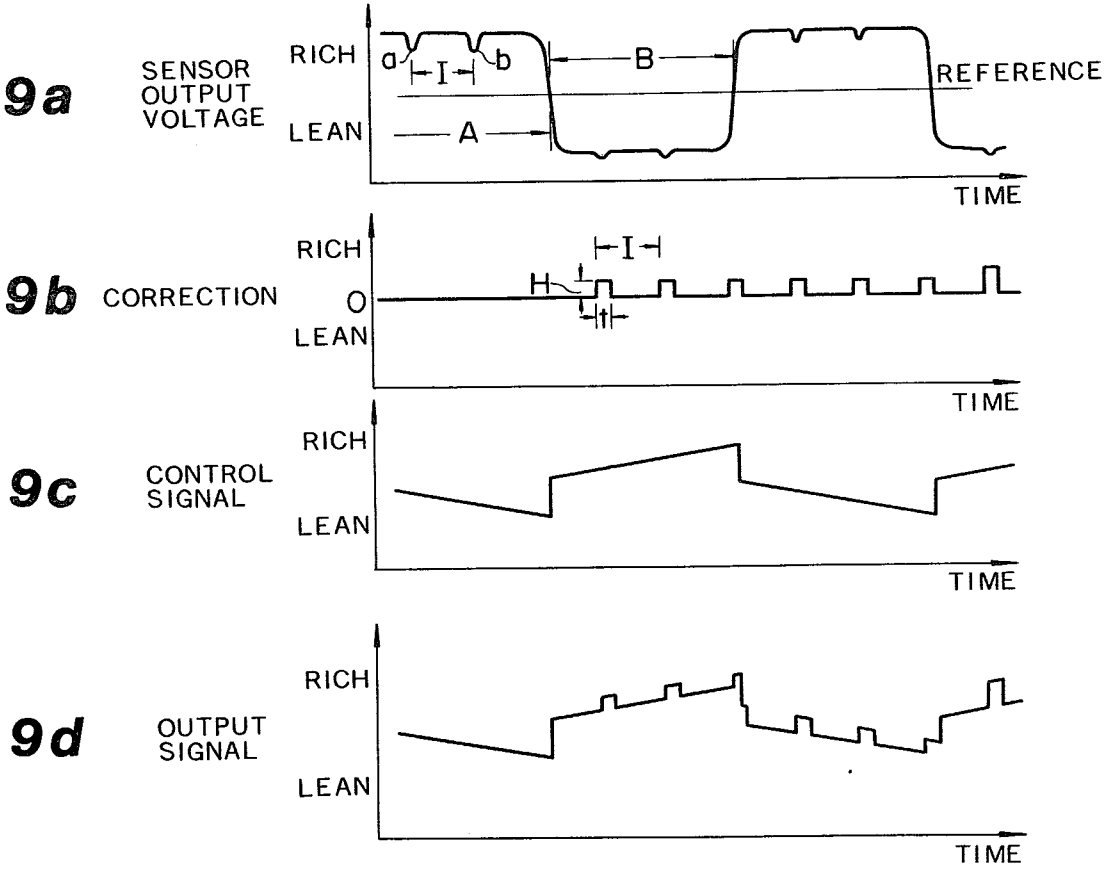

A third embodiment of the present invention is shown in FIGS. 7 to 9. Unlike the system of FIG. 1, a fuel supplying device 20 of this embodiment is a carburetor. An output section 22 of a control unit 21 produces a pulse signal and send it to a solenoid valve provided in an auxiliary air bleed. Thus, the air fuel ratio is controlled by the solenoid valve under command of the pulse signal in an on/off manner. An output signal of an oxygen sensor 1 is converted into a digital form by an analog-to-digitial converter in an input section 10 of the control unit 21, and processed by a control section or CPU 12 in accordance with a predetermined program stored in a memory section 13. Output data thus obtained by the CPU is transferred through a bus 11 to the output section 22.

An example of programs used here is shown in FIG. 8. When a power supply is connected to the control unit 21, the CPU starts executing a routine beginning with a reset step 300. At a step 301, the CPU executes an instruction of initialization, and at a step 302, repeatedly performs normal operations by processing various input data.

In a timer interrupt routine of steps 310 to 316 which is started by a timer interrupt signal periodically generated, the CPU first instructs the analog-to-digital converter to start its conversion while selecting, one after another, input data for the converter among different sources. At a step 312, the CPU increments a timing count T which is used to measure the period of the 02 sensor signal fluctuation, as explained below. At a step 313, the CPU determines a correction value for that point of time in accordance with a correction pattern of the air fuel ratio, as shown in FIG. 9*b*, by way of example. Such a correction pattern is determined in accordance with the 02 sensor signal fluctuation. At a step 314, the CPU adds the correction value to a basic control signal which is determined in accordance with a conventional control action such as a proportional plus integral control action as shown in FIG. 9*c*. The thus determined value is transferred, as output data, to the output section 22 at a step 315.

In a converter interrupt routine beginning from a step 320 which is started by a converter interrupt signal, the CPU first reads output data of the analog to digital converter, and then checks if it is the 02 sensor signal, at a step 322. If it is not the 02 sensor signal, the CPU stores the data in a predetermined memory location depending upon sources of the data, at a step 323. If the input data is the 02 sensor signal, the CPU checks whether or not the input data is greater than a predetermined reference value, at a step 324. If it is, that is, the 02 sensor signal is in the period A of FIG. 9A, then, at a step 325, the CPU determines whether the current entry value of the 02 sensor signal is a local minimum value which corresponds to a point a or b in FIG. 9*a*. This is done by detecting a change of the derivative of the 02 sensor signal from minus to zero.

If the current entry of the 02 sensor signal is a local minimum value, the CPU measures a time interval I between two successive occurrences of a local minimum by using the timing count T, at a step 326. At a step 327, the CPU finds a minimum value (the smallest value of local minimum values). If the current entry is not a local minimum value, the CPU calculates a maximum value at a step 328. At a step 329, the CPU manipulates the control signal so as to increase the air fuel ratio in a conventional manner, as shown in FIG. 9*c*.

If, on the other hand, the current entry of the 02 sensor signal is smaller than the reference value, that is, the 02 sensor signal is in the period B of FIG. 9A, then the CPU calculates the difference D between the maximum value and the minimum value which are obtained in the period A, at a step 330, and then compares the difference with a predetermined value DR, at a step 331. If D is smaller than DR, the CPU directly goes to a step 332 according to a judgement that there is no need to correct the control signal. At the step 332, the CPU manipulates the control signal so as to decrease the air fuel ratio in a conventional manner. If D is greater than DR, the CPU tries to correct the control signal so as to reduce the unevenness of the air fuel ratio, at steps 333 to 336. At the step 333, the CPU determines whether D becomes larger than a previous value which is a value of D obtained in the previous period A. If D is smaller than the previous value, it can be judged that the correction of the control signal in the previous time is well-directed. Accordingly, the CPU performs the correction of the control signal, in the same direction as the previous time, by varying H and/or t of FIG. 9*b*, for example, at step 334. If D is greater than the previous value, the CPU reverses the direction of the correction, at a step 335.

At the step 336, the CPU determines a pattern of the correction signal in relation to time in accordance with the results of the steps 334 and 335 and the time interval I measured at the step 326. An example of the correction signal pattern is shown in FIG. 9*b*, in which the correction signal is a pulse signal whose pulse spacing is equal to the time interval I of FIG. 9*a*. In this case, it is preferable to determine a phase relation between the correction signal and the 02 sensor signal in consideration of a time delay from the fuel supplying device 20 to the 02 sensor. For brevity, the time delay is disregarded in FIG. 9.

In the embodiment shown in FIG. 7, the carburetor 20 supplies an air fuel mixture in common to all the cylinders. In spite of this, the cylinder to cylinder air fuel ratio distribution takes place mainly because the air fuel mixture flows to individual cylinders are not the same. In this embodiment, the air fuel ratio is controlled uniform among the cylinders by changing the air fuel ratio of an intake mixture in timing relation with the sequence of the intake periods of the individual cylinders.

Thus, in this embodiment, the pattern of the 02 sensor signal fluctuation is detected, and the control signal is corrected in accordance with the detected 02 sensor signal pattern so as to level the air fuel distribution. This is very advantageous not only for leveling the air fuel ratio distribution but also for reducing a pulsating change of the air fuel ratio common to all the cylinders due to pulsations of air flow and/or fuel flow.

The occurrences of local minimums of the 02 sensor signal, that is, the influences of exhaust gases from individual cylinders, are in synchronism with engine rotation. Accordingly, local minimums of the 02 sensor signal occur at regular intervals, so that, in the pulse train of the correction signal, pulses occur at regular intervals, as shown in FIG. 9*b*.

Thus, the fluctuations of air fuel ratio due to influences of individual cylinders occur in synchronism with engine rotation, so that it is optional to determine the time interval I as a function of the period of engine operating cycle. For example, I is made equal to the period of engine operating cycle (two crankshaft revolutions of four cycle engine). This arrangement requires additionally an engine rotation pickup, but eliminates the necessity of the program for calculating the time interval I and can provide good control performance even during engine speed changes.

Instead of an ordinary carburetor used as the fuel supplying device 20, it is possible to employ other types of fuel supplying device such as a single point injector system and an injection type carburetor.

In the embodiments mentioned above, the fluctuation of the 02 sensor signal is examined during the periods where the 02 sensor signal is greater than the reference value, that is, the air fuel ratio is lower because the 02 sensor characteristic curve is somewhat less steep and therefore more advantageous during the rich periods than the lean periods where the air fuel ratio is higher. However it is still possible to employ the lean periods for the detection of the 02 sensor signal fluctuation.

As explained above, the air fuel ratio control systems and methods of the first, second and third embodiments of the present invention are arranged to detect the small scale fluctuation of the 02 sensor signal and control the air fuel ratio of a mixture supplied to each cylinder so as to reduce the fluctuation. Accordingly, these systems and methods can level the cylinder to cylinder air fuel ratio distribution efficiently and thereby provide cleaner exhaust emission and improved fuel economy.

Even if the injectors of the individual cylinders are different in their operational characteristics from one to another, the control systems and methods of the first and second embodiments can automatically reduce the detrimental effects of the differences between the injectors, so that production of the injection system can be enhanced by widening the allowable range of usable injectors.

The control system and method of the second embodiment are arranged to directly detect which cylinder is a source of an 02 sensor signal fluctuation, so that good response characteristic can be obtained.

In the third embodiment, there is provided only one fuel supplying device common to all the cylinders, and this is advantageous in economy.

What is claimed is:

1. An air fuel ratio feedback control method for a multi-cylinder engine comprising;

sensing exhaust gas composition at a confluence of exhaust streams from individual cylinders and producing a sensor signal indicative of the air fuel ratio, producing a control signal in accordance with the sensor signal, examining the fluctuation of the sensor signal within a limited time interval to detect the cylinder to cylinder distribution of the air fuel ratio, during said limited time interval the sensor signal remaining on either side of a target reference value whereas the sensor signal swings on both sides of the target reference value owing to a controlled oscillation of the control system, modifying the control signal so as to reduce the sensor signal fluctuation to make the detected cylinder to cylinder air fuel distribution uniform, supplying to each individual combustion chamber an air fuel mixture of an air fuel ratio controlled differently from others under the command of the modified control signal.

2. A feedback air fuel ratio control system for a multi-cylinder engine, the system comprising;

an air fuel ratio sensor for sensing exhaust gas composition at a confluence of exhaust streams from individual cylinders and producing a sensor signal indicative of air fuel ratio, a control unit for producing a control signal in accordance with the sensor signal, fuel supplying means for supplying, to the individual cylinders, an air fuel mixture of a controlled air fuel ratio under the command of the control signal, said control unit comprising means for examining the fluctuation of the sensor signal to detect the cylinder to cylinder distribution of the air fuel ratio, and means for modifying the control signal so as to make the detected cylinder to cylinder air fuel ratio distribution uniform, said fuel supplying, means being capable of providing each cylinder with a mixture of an air fuel ratio controlled differently from others under the command of the modified control signal, said examining means being arranged to detect the sensor signal fluctuation within a limited time interval during which the sensor signal remains on either side of a target reference value whereas the sensor signal swings on both sides of the target reference value owing to a controlled oscillation of the control system, said modifying means modifying the control signal so as to reduce the sensor signal fluctuation.

3. An air fuel ratio control system according to claim 2, wherein said fuel supplying means comprises a device that supplies an air fuel mixture to all the cylinders in common and is capable of controlling the air fuel ratio of the mixture in response to the control signal, said modifying means of said control unit being arranged to modify the control signal in accordance with the sequence of intake periods of the individual cylinders.

4. An air fuel ratio control system according to claim 3, wherein said modifying means of said control unit prepares a correction signal which varies as a function of time in accordance with the sensor signal fluctuation detected by said examining means and modifying the control signal by adding the correction signal to the control signal.

5. An air fuel ratio control system according to claim 4, wherein said examining means detects local minimums of the sensor signal within the limited time interval during which the sensor signal remains on the fuel rich side of the reference value, and measures time intervals between successive occurrences of the local minimums, said correction signal of said modifying means is a pulse signal whose pulses occur in a timing relation with the occurrence of the local minimums.

6. An air fuel ratio control system according to claim 5, wherein said examining means detects the maximum value of the sensor signal and the smallest value among the detected local minimums within said limited time interval of the fuel rich side, and calculates the difference between the maximum value and the smallest value, said modifying means varying the product of a pulse duration and a pulse amplitude of each pulse of the pulse signal depending upon whether the difference calculated by said examining means is increased or decreased by the manipulation of the control signal in a previous time.

7. An air fuel ratio control system according to claim 2, wherein said fuel supplying means comprises a plurality of injector means each of which is provided for each cylinder, said control signal comprising a plurality of individual control signals each of which is separately sent to each of said injector means, said control signal modifying means being arranged to modify said individual control signals individually so as to control the air fuel ratio of each cylinder individually.

8. An air fuel ratio control system according to claim 7, further comprising time detecting means for detecting a specific reference time point in an engine operating cycle of each cylinder to determine a sampling time of each cylinder that is timed in relation with its reference time point, and wherein said examining means samples the sensor signal at the respective sampling times of the cylinders, stores the respective sampled values of the cylinders, and detects the air fuel ratio deviation of each cylinder by comparing these sampled values, said modifying means modifying the individual control signals individually in accordance with the air fuel ratio deviations of the individual cylinders.

9. An air fuel ratio control system according to claim 8, wherein the sampling time of each cylinder is the time when the piston of that cylinder reaches the top dead center on an exhaust stroke.

10. An air fuel ratio control system according to claim 8, wherein the sampling time of each cylinder is the end of predetermined time interval beginning from the time when the piston of that cylinder reaches the top dead center on an exhaust stroke.

11. An air fuel ratio control system according to claim 7, wherein said examining means of said control unit is arranged to detect the amplitude of the sensor signal fluctuation within the limited interval of time, said modifying means of said control unit modifying the individual control signals individually to reduce the amplitude of the sensor signal fluctuation within the limited interval.

12. An air fuel ratio control system according to claim 11, wherein said modifying means is arranged to decide whether to increase or decrease each of the individual control signal, one by one, depending upon whether the amplitude of the sensor signal fluctuation is increased or decreased by the manipulation of that individual control signal in a previous time.

13. An air fuel ratio control system according to claim 12, wherein said modifying means performs the modification of the individual control signals only when the amplitude of the sensor signal fluctuation is greater than a predetermined allowable value.

14. An air fuel ratio control system according to claim 13, wherein said examining means detects the maximum value and the minimum value of the sensor signal within the limited interval and calculates the difference therebetween to determine the amplitude of the sensor signal fluctuation.

15. An air fuel ratio control system according to claim 14, wherein said examining means detect the amplitude of the sensor signal fluctuation during periods during which the sensor signal remains on the fuel rich side of the reference value.

* * * * *